US009352584B2

(12) United States Patent
Ume

(10) Patent No.: US 9,352,584 B2
(45) Date of Patent: May 31, 2016

(54) PRINTING APPARATUS, CONTROL METHOD THEREFOR, AND STORAGE MEDIUM STORING CONTROL PROGRAM THEREFOR

(71) Applicant: CANON KABUSHIKI KAISHA, Tokyo (JP)

(72) Inventor: Kazuhiro Ume, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/885,464

(22) Filed: Oct. 16, 2015

(65) Prior Publication Data

US 2016/0114593 A1 Apr. 28, 2016

(30) Foreign Application Priority Data

Oct. 23, 2014 (JP) ..... 2014-216329

(51) Int. Cl.
*B41J 2/35* (2006.01)
*B41J 2/335* (2006.01)

(52) U.S. Cl.
CPC ..... *B41J 2/335* (2013.01)

(58) Field of Classification Search
USPC ..... 347/9, 14–16, 19, 211, 215, 218, 221
See application file for complete search history.

(56) References Cited

U.S. PATENT DOCUMENTS 5,252,986 A * 10/1993 Takaoka ..... H04N 1/4057 347/15
5,825,377 A * 10/1998 Gotoh ..... H04N 1/52 347/15
6,386,673 B1 * 5/2002 Takahashi ..... D06P 5/30 347/19
2014/0139574 A1 * 5/2014 Asada ..... B41J 2/2107 347/9

FOREIGN PATENT DOCUMENTS

JP 2007-276259 A 10/2007

* cited by examiner

*Primary Examiner* — Kristal Feggins
(74) *Attorney, Agent, or Firm* — Fitzpatrick, Cella, Harper & Scinto

(57) ABSTRACT

A printing apparatus that is capable of obtaining density more than density that is obtained by repeating the same printing process a plurality of times without affecting resolution and tone expression. A printing unit prints an image by transferring ink to a printing sheet with a thermal head according to print data of a multiple value. A control unit controls the printing unit so as to change a maximum exothermic frequency in one dot according to a transfer frequency at the time of transferring ink of a same color a plurality of times to overlap, when an image is printed based on the print data by transferring ink of the same color the plurality of times to overlap.

11 Claims, 9 Drawing Sheets

PRINTING APPARATUS, CONTROL METHOD THEREFOR, AND STORAGE MEDIUM STORING CONTROL PROGRAM THEREFOR

BACKGROUND OF THE INVENTION

1. Field of the Invention

The present invention relates to a printing apparatus, a control method therefor, and a storage medium storing a control program therefor, and in particular, relates to a printing method of printing with inks of a plurality of colors, such as yellow (Y), magenta (M), and cyan (C), and of printing with the inks of the plurality of colors again.

2. Description of the Related Art

A thermal sublimation printing apparatus attracts attention in recent years as a printing apparatus that prints a photograph (an image) obtained by an image pickup apparatus, such as a digital camera. A thermal sublimation printing apparatus makes thermal sublimation ink ribbons in yellow (Y), magenta (M), and cyan (C) be in pressure contact with a printing sheet with a thermal head and a platen roller. Then, the printing sheet is transferred while exothermic elements of a thermal head are selectively heated in a press contact state, which sublimates ink on the ink ribbons to make the ink adsorb to the printing sheet and expresses a tone.

In this printing apparatus, when printing with one color is completed, the printing sheet is again returned to a print starting position, and prepares for printing of the next color. Then, an overcoat layer is formed on the printing sheet with transparent thermally fused material as a protective layer after finishing the printings in yellow (Y), magenta (M), and cyan (C). As a result, the printed matter is protected.

In printing, a thermal sublimation ink ribbon on which yellow (Y), magenta (M), cyan (C), and overcoat (OC) sections are arranged continuously is used. In order to detect a head of each color section, two head markers are formed at the starting point of the yellow section, and one head marker is formed at the starting point of each of the magenta (M), cyan (C), and overcoat (OC) sections, for example.

The head markers of the yellow (Y) section are detected first. Then, the head marker of the magenta (M) section, the head marker of the cyan (C) section, and the head marker of the overcoat (OC) section are sequentially detected. Accordingly, printing is certainly started from the yellow, which is the first color.

Above-mentioned printing method employs three ink sheets in total, i.e., one yellow (Y) ink sheet, one magenta (M) ink sheet, and one cyan (C) ink sheet. On the other hand, there is a printing method that repeats printing twice using two sets of yellow (Y), magenta (M), and cyan (C) ink sheets (six sheets) in order to raise the highest attained density of printed matter, for example (see Japanese Laid-Open Patent Publication (Kokai) No. 2007-276259 (JP 2007-276259A)).

However, since the printing apparatus disclosed in the above-mentioned publication repeats the same printing process twice, it is difficult to obtain density more than density that is obtained by repeating the printing process twice. That is, the conventional printing apparatus needs to further repeat the printing process if further deep print density is desired.

SUMMARY OF THE INVENTION

The present invention provides a printing apparatus, a control method therefor, a storage medium storing a control program therefor, which are capable of obtaining density more than density that is obtained by repeating the same printing process a plurality of times without affecting resolution and tone expression.

Accordingly, a first aspect of the present invention provides a printing apparatus comprising a printing unit configured to print an image by transferring ink to a printing sheet with a thermal head according to print data of a multiple value, and a control unit configured to control the printing unit so as to change a maximum exothermic frequency in one dot according to a transfer frequency at the time of transferring ink of a same color a plurality of times to overlap, when an image is printed based on the print data by transferring ink of the same color the plurality of times to overlap.

Accordingly, a second aspect of the present invention provides a control method for a printing apparatus, the control method comprising a printing step of printing an image by transferring ink to a printing sheet with a thermal head according to print data of a multiple value, and a control step of controlling so as to change a maximum exothermic frequency in one dot according to a transfer frequency at the time of transferring ink of a same color a plurality of times to overlap, when an image is printed based on the print data by transferring ink of the same color the plurality of times to overlap.

Accordingly, a third aspect of the present invention provides a non-transitory computer-readable storage medium storing a control program causing a computer to execute the control method of the second aspect.

According to the present invention, the printing is controlled so that the maximum exothermic frequency in one dot is changed in response to the transfer frequency of ink. This gives density more than density that is obtained by repeating the same printing process a plurality of times without affecting resolution and tone expression.

Further features of the present invention will become apparent from the following description of exemplary embodiments with reference to the attached drawings.

BRIEF DESCRIPTION OF THE DRAWINGS

FIG. 2A is a view showing a state where a sheet front end is detected, FIG. 2B is a view showing a state where a sheet is conveyed to a print starting position, FIG. 2C is a view showing a state where a yellow marker search is completed, FIG. 2D is a view showing a state where a conveyance of a printing sheet by the predetermined number of steps is completed, and FIG. 2E is a view showing a state where the conveyance of the printing sheet is finished.

FIG. 5A is a view showing two examples of the maximum exothermic frequencies in one dot, FIG. 5B is a view showing a relation between an exothermic frequency and attained density in a case where the maximum exothermic frequency is low, FIG. 5C shows a relation between the exothermic frequency and the attained density in a case where the maximum exothermic frequency is high, and FIG. 5D is a view showing a relation between density of print data and a state of division.

DESCRIPTION OF THE EMBODIMENTS

Hereafter, an example of a printing apparatus according to an embodiment of the present invention will be described in detail with reference to the drawings.

Figure 1:
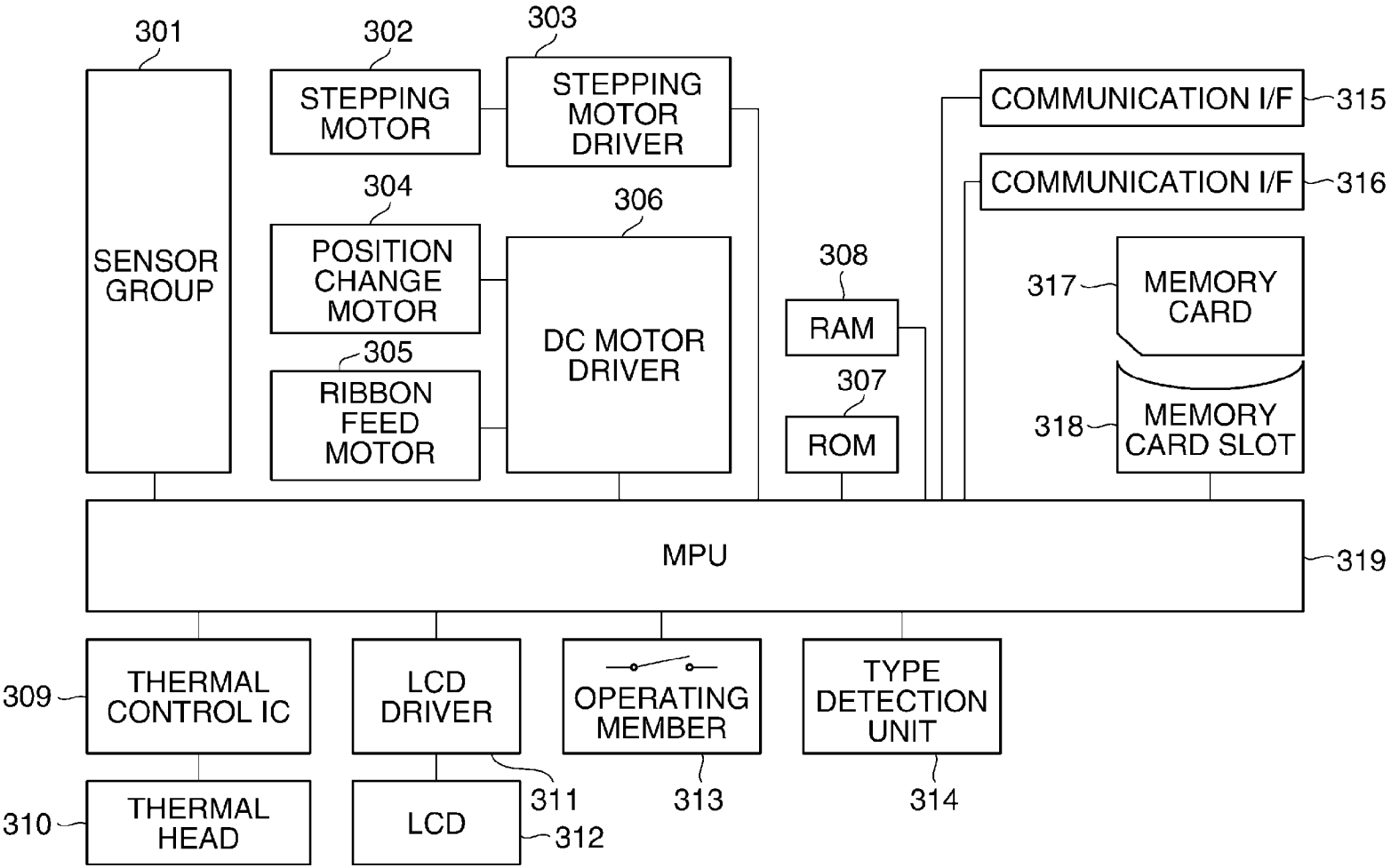
FIG. 1 is a block diagram schematically showing a configuration of a printing apparatus according to a first embodiment of the present invention.

FIG. 1 is a block diagram schematically showing a configuration of a printing apparatus according to a first embodiment of the present invention.

The illustrated printing apparatus is what is called a thermal sublimation printing apparatus, and prints using inks of a plurality of colors (for example, yellow, magenta, and cyan). The illustrated printing apparatus has a sensor group 301. This sensor group 301 includes a sheet-front-end sensor, an ink ribbon head detection sensor, etc., for example. A stepping motor driver 303 drives a stepping motor 302 under control of an MPU (Micro Processor Unit) 319, and conveys a printing sheet. A position change motor 304 makes a thermal head 310 contact with an ink ribbon (not shown) and a printing sheet (not shown) while giving pressure or be separated therefrom.

A ribbon feed motor 305 winds up an ink ribbon. A DC motor driver 306 drives the position change motor 304 and the ribbon feed motor 305 under control of the MPU 319. A flash memory is used as a ROM (Read Only Memory) 307, for example, and the ROM 307 stores a control program for the printing apparatus.

A RAM (Random Access Memory) 308 is used when print image data is generated etc., and the print image data is developed onto the RAM 308. The thermal head 310 is controlled according to the print image data developed onto the RAM 308 for printing.

A communication interface 316 is used for direct print, and a communication interface 315 is used for connection to a personal computer. For example, a digital camera can be connected to the communication interface 316. When a digital camera is connected to the communication interface 316, it is possible to print in response to an operation on the digital camera. Moreover, when a personal computer is connected to the communication interface 315, it is possible to print in response to an operation on the personal computer.

The illustrated printing apparatus is provided with a memory card slot 318. And this memory card slot 318 is equipped with a memory card 317. Although the illustrated example has the single memory card slot 318, a plurality of memory card slots 318 may be provided.

A thermal control IC 309 drives the thermal head 310 that thermally transfers ink under the control of the MPU 319. An LCD driver 311 drives an LCD (Liquid Cristal Display) 312 under the control of the MPU 319. An operating member 313 includes a power switch. Printing is instructed and an image is selected with the operating member 313.

As illustrated, a type detection unit 314 is connected to the MPU 319. The type detection unit 314 detects types of a printing sheet cassette and an ink ribbon cassette. The MPU 319 controls the printing process of the printing apparatus. For example, the MPU 319 detects a state of the operating member 313, detects a state of the sensor group 301, and performs the printing process as mentioned latter. Then, the MPU 319 is a dedicated IC that is provided with an image processing function, a memory card accessing function, a communication interface function, etc. in addition to a microprocessor function.

The MPU 319 reads a compressed image file from the memory card 317 attached to the memory card slot 318 and applies an expansion process. Then, the MPU 319 controls the LCD driver 311 to display an image after applying the extension process on the LCD 312. When a user selects an image displayed on the LCD 312 with the operating member 313, the MPU 319 performs the printing process for the selected image concerned.

Furthermore, when receiving a print instruction from the operating member 313 or when receiving a print instruction from a digital camera through the communication interface 315 or a personal computer through the communication interface 316, the MPU 319 starts a printing operation.

Figure 2A:
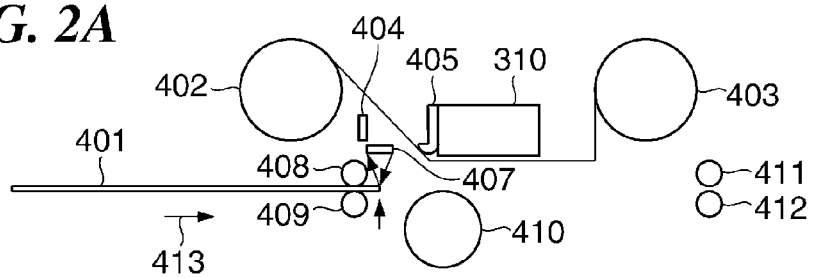
FIG. 2A through FIG. 2E are views for describing a printing process by the printing apparatus shown in FIG. 1.
Figure 2B:
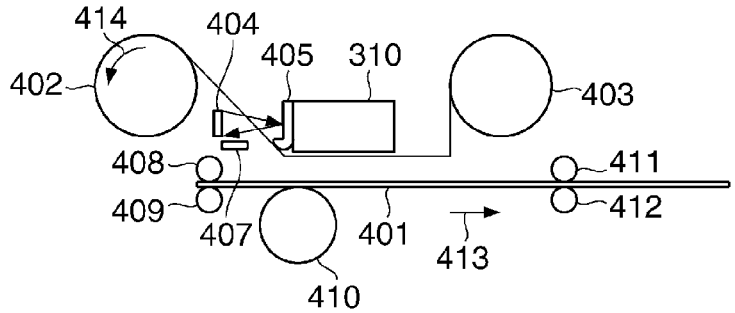
Figure 2C:
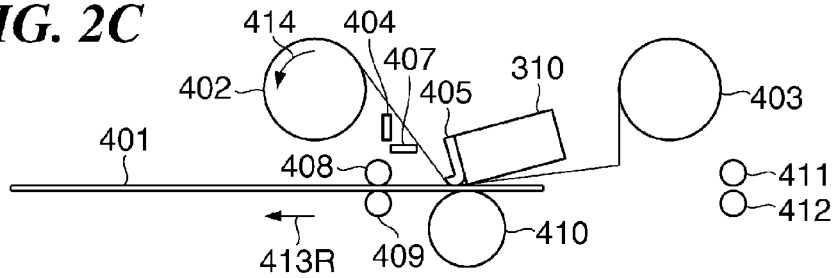
Figure 2D:
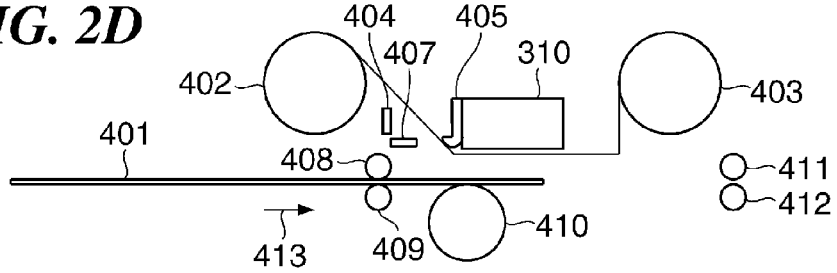
Figure 2E:
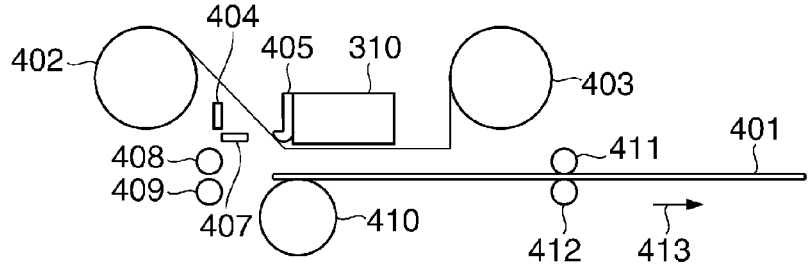

FIG. 2A through FIG. 2E are views for describing the printing process by the printing apparatus shown in FIG. 1. FIG. 2A is a view showing a state where a sheet front end is detected, and FIG. 2B is a view showing a state where a sheet is conveyed to a print starting position. Moreover, FIG. 2C is a view showing a state where a yellow marker search is completed, and FIG. 2D is a view showing a state where a conveyance of a printing sheet by the predetermined number of steps is completed. Furthermore, FIG. 2E is a view showing a state where the conveyance of the printing sheet is finished.

A thermal sublimation ink sheet (ink ribbon) is wound around ink ribbon cassettes 402 and 403. Here, the ink sheet is supplied from the ink ribbon cassette 403, and the ink sheet after printing is wound up by the ink ribbon cassette 402. A ribbon marker sensor 404 detects head markers of the ink sheet.

The ribbon marker sensor 404 irradiates light from a light emitting diode toward a reflector 405 mounted on a separating plate that is used for separating an ink sheet from a printing sheet. Then, the ribbon marker sensor 404 receives the reflected light with a photosensor, and detects a head marker.

A printing sheet 401 is pinched and conveyed by a grip roller 409 and the pinch roller 408. A sheet-front-end sensor 407 detects a front end of a printing sheet. The sheet-front-end sensor 407 irradiates light from a light emitting diode towards a path along which the printing sheet 401 is conveyed. Then, when the front end of the printing sheet 401 passes, a photosensor detects the front end of the printing sheet 401 by receiving reflected light from the printing sheet 401.

It should be noted that the ribbon marker sensor 404 and the sheet-front-end sensor 407 are included in the sensor group 301 shown in FIG. 1.

Figure 3A:
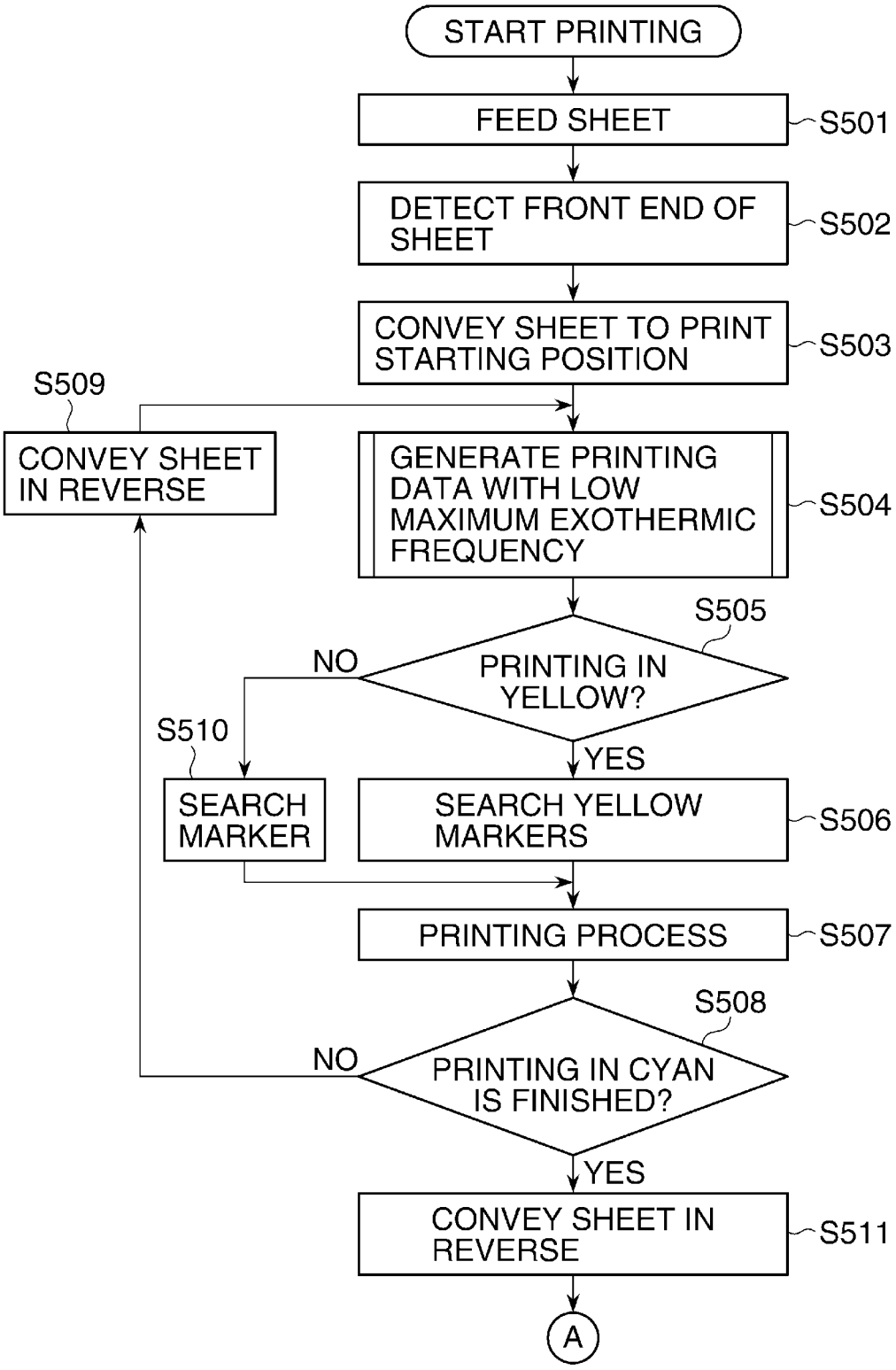
FIG. 3A and FIG. 3B are flowcharts showing the printing process executed by the printing apparatus shown in FIG. 1.
Figure 3B:
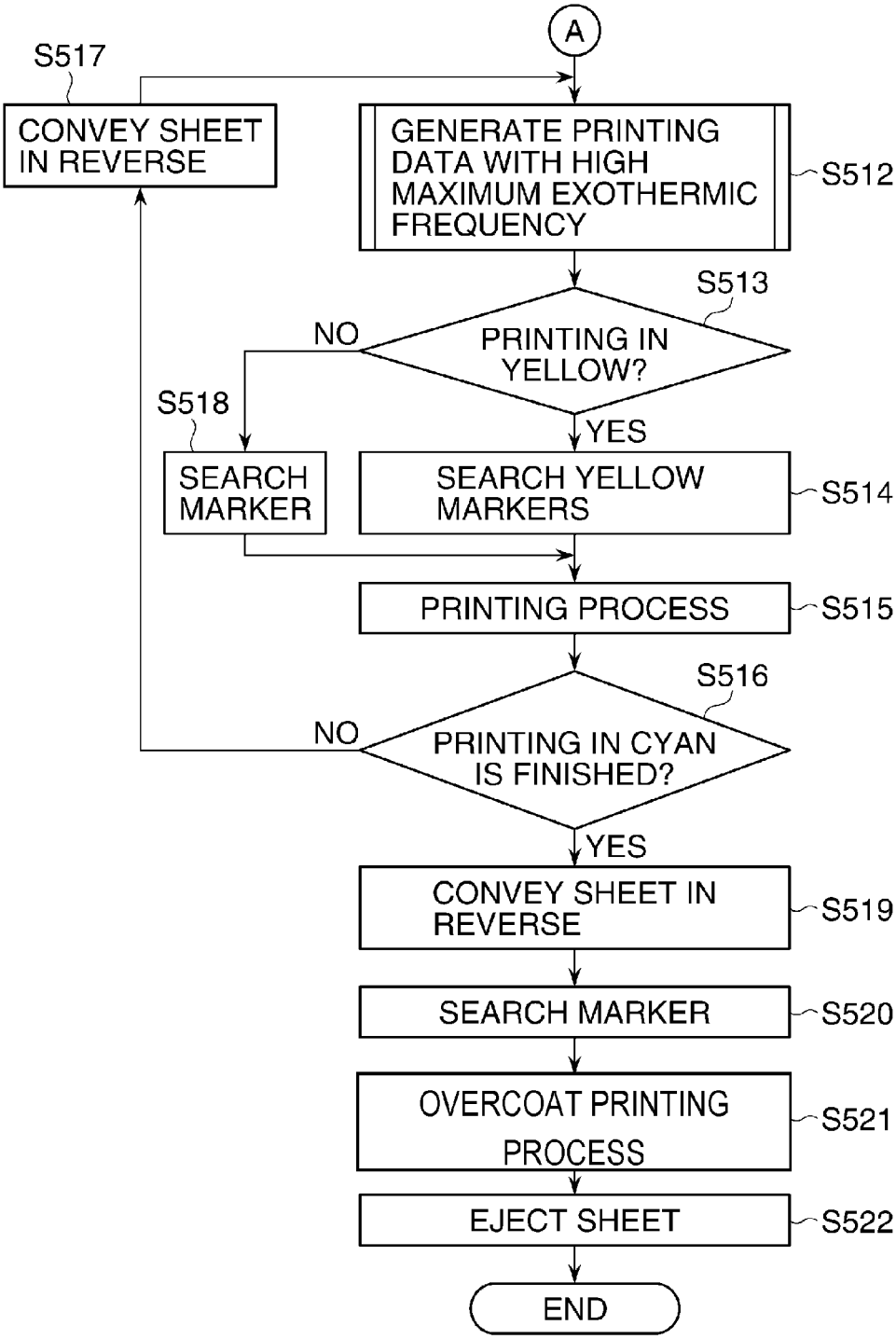

FIG. 3A and FIG. 3B are flowcharts showing the printing process executed by the printing apparatus shown in FIG. 1.

When the printing process is started, the MPU 319 drives the stepping motor 302 through the stepping motor driver 303 to feed a sheet (step S501). Here, the printing sheet 401 is supplied from a sheet cassette with a feed roller (not shown), and is conveyed in a direction shown by a solid line arrow 413 with a grip roller 409 and a pinch roller 408 (FIG. 2A).

When the sheet-front-end sensor 407 detects the front end of the printing sheet (step S502), the MPU 319 drives the stepping motor 302 to convey the printing sheet 401 in the direction indicated by the solid line arrow 413 to the print starting position (FIG. 2B, step S503).

FIG. 2A shows the state where the front end of the printing sheet has been detected, and the thermal head 310 does not come into press contact with the platen roller 410. When the sheet-front-end sensor 407 detects the front end of the printing sheet 401, the MPU 319 manages the number of driving steps of the stepping motor 302 that drives the grip roller 409, and controls the conveyance quantity of the printing sheet 401. Accordingly, the printing sheet is conveyed to the print starting position as shown in FIG. 2B.

When the printing sheet is conveyed to the print starting position, the MPU 319 drives the ribbon feed motor 305, which is a DC motor, so as to wind up the ink ribbon cassette 402 in the direction indicated by a solid line arrow 414. Then, the MPU 319 detects yellow head markers on the ink ribbon with the ribbon marker sensor 404.

Figure 4:
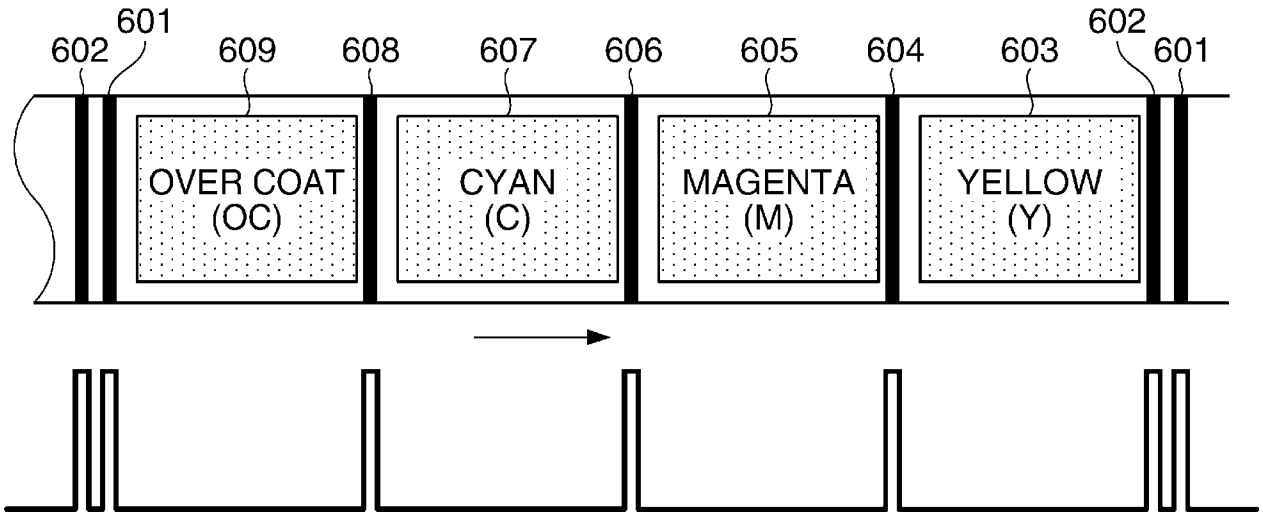
FIG. 4 is a view showing an example of an ink ribbon used with the printing apparatus shown in FIG. 1.

FIG. 4 is a view showing an example of the ink ribbon used with the printing apparatus shown in FIG. 1.

On the ink ribbon, a yellow (Y) section 603, a magenta (M) section 605, a cyan (C) section 607, and an overcoat (OC) section 609 are arranged in this order. And a plurality of sets of these sections are arranged. Then, head markers 601 and 602 are formed in front of the yellow (Y) section 603. This configuration allows the yellow (Y) section 603 to be distinguished from other sections.

Furthermore, a head marker 604, a head marker 606, and a head marker 608 are respectively formed in front of the magenta (M) section 605, the cyan (C) section 607, and the overcoat (OC) section 609. These head markers have the same shape.

After conveying the printing sheet to the print starting position, the MPU 319 controls print data to divide, and generates below-mentioned printing data with a low maximum exothermic frequency (referred to as first printing data) for each color (step S504). The first printing data in yellow (Y) is generated first.

Subsequently, the MPU 319 determines whether the printing in yellow will be performed (step S505). When it is determined that the printing in yellow will be performed (YES in the step S505), the MPU 319 searches for the yellow markers (the head markers 601 and 602) (step S506). When the yellow marker search is completed, the MPU 319 performs the printing process (step S507).

Here, as shown in FIG. 2C, the MPU 319 drives the position change motor 304, which is a DC motor, so that the thermal head 310 comes into press contact with the platen roller 410. Then, the MPU 319 applies an electric current to the thermal head 310, and drives the ribbon feed motor 305, which is a DC motor, so as to wind up the ink ribbon in the direction indicated by the solid line arrow 414. At this time, the MPU 319 conveys the printing sheet 401 in a direction indicated by a solid line arrow 413R (the reverse direction to the direction indicated by the solid line arrow 413 shown in FIG. 2B), makes ink in the ink ribbon sublimate, and makes the ink adsorb to the printing sheet.

The MPU 319 manages the conveyance distance of the printing sheet 401 according to the number of steps of the stepping motor 302 that drives the grip roller 409. When the printing sheet has been conveyed by a predetermined number of steps, the MPU 319 stops the stepping motor 302 and stops the electric current to the thermal head 310. Then, the MPU 319 releases the press contact between the platen roller 410 and the thermal head 310 (see FIG. 2D).

At this time, the tone of the printed image is controlled by the exothermic frequency of the thermal head 310 per dot.

When the printing process in yellow is completed, the MPU 319 determines whether the printing in cyan is completed (step S508). When the printing in cyan is not completed (NO in the step S508), the MPU 319 conveys the printing sheet in the direction indicated by the solid line arrow 413 as shown in FIG. 2D to the print starting position (step S509).

At this time, the MPU 319 conveys the printing sheet 401 in the reverse direction by the predetermined number of steps concerning the conveyance for the printing in yellow (Y) in order to return the printing sheet 401 by the conveyance quantity during the printing in yellow. As a result, the printing sheet returns to the state shown in FIG. 2B.

The MPU 319 generates first printing data in magenta in the step S504 after that. Then, it is determined whether the printing in yellow will be performed in the step S505. Since the printing in yellow will not be performed at this time (NO in the step S505), the MPU 319 searches for the magenta marker (the head marker 604) (step S510). Then, the MPU 319 performs the printing process in magenta (M), which is the next color according to the arrangement in the ink ribbon, in the step S507.

Subsequently, it is again determined that the printing in cyan is not finished in the process in the step S508, the MPU 319 proceeds with the process to the step S509, and performs the printing process in cyan in the step 507 similarly. Thus, the MPU 319 prints the first printing data in yellow (Y), magenta (M), and cyan (C) onto the printing sheet in order.

When the printing process in cyan (C) is completed (YES in the step S508), the MPU 319 reversely conveys the printing sheet to the print starting position (step S511). Then, the MPU 319 generates printing data with high maximum exothermic frequency (referred to as second printing data) for each color (step S512) as mentioned later. The second printing data in yellow (Y) is generated first.

Following the process in the step S512, the MPU 319 executes processes in steps S513 through S518. Since the processes in the steps S513 through S518 are equivalent to the processes in the steps S505 through S510, the detailed descriptions are omitted.

When the second printing processes are finished to cyan (C) (YES in the step S516), the MPU 319 reversely conveys the printing sheet to the print starting position (step S519). Then, the MPU 319 searches for the overcoat marker (the head marker 608) (step S520). When the search for the overcoat marker is completed, the MPU 319 performs the printing process of overcoat (OC) by the method identical to the above-mentioned method (step S521). Then, the MPU 319 ejects the printing sheet, which is printed matter, in step S522, and finishes the printing process.

In the process in the step S522, the MPU 319 drives ejecting rollers 411 and 412 so that the printing sheet moves in the direction indicated by the solid line arrow 413 as shown in FIG. 2E and is ejected.

Here, the tone expression by the thermal head 310 in the printing apparatus shown in FIG. 1 will be described. In the sublimation printing apparatus shown in FIG. 1, the tone expression is possible for every dot. Specifically, density of one dot is controllable by controlling an exothermic frequency for driving the thermal head (exothermic element of the thermal head) during an exothermic period corresponding to one dot. Furthermore, since a recording sheet and ink are conveyed while heating the thermal head, an ink transfer area in an auxiliary scanning direction (a direction that intersects perpendicularly with a principal scanning direction that is an arrangement direction of exothermic elements) is controllable by controlling the exothermic frequency.

Figure 5A:
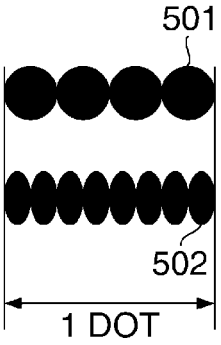
FIG. 5A through FIG. 5D are views for describing an exothermic frequency of a thermal head in the printing apparatus shown in FIG. 1.
Figure 5B:
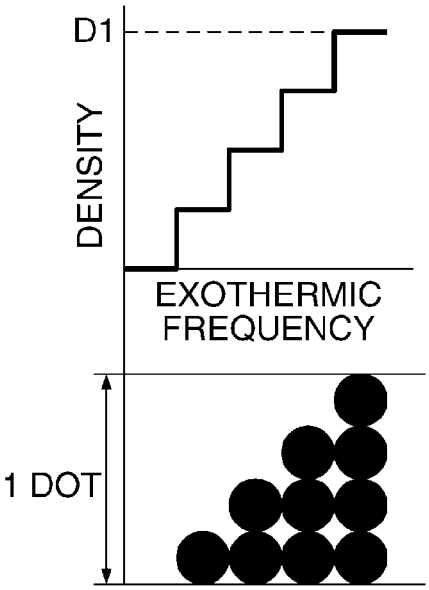
Figure 5C:
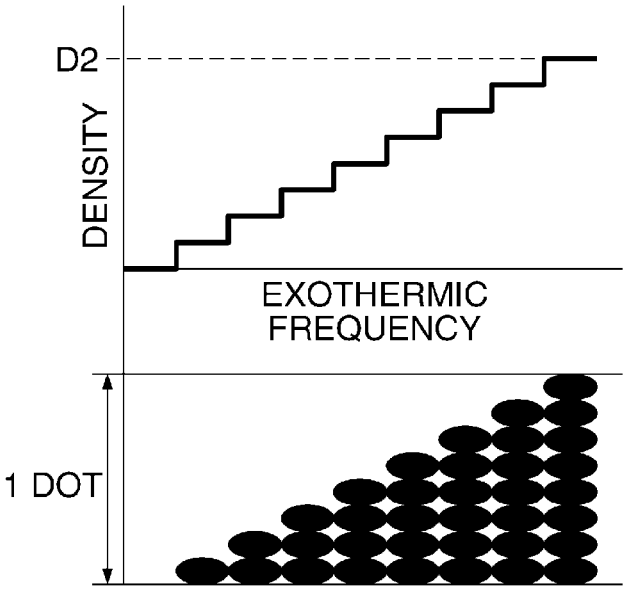
Figure 5D:
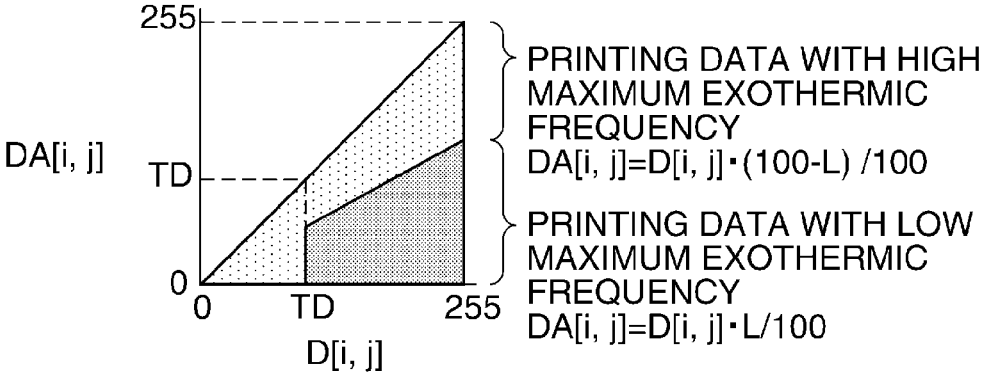

FIG. 5A through FIG. 5D are views for describing an exothermic frequency of the thermal head 310 in the printing apparatus shown in FIG. 1. FIG. 5A is a view showing two examples of the maximum exothermic frequencies in one dot, and FIG. 5B is a view showing a relation between an exothermic frequency and attained density in a case where the maximum exothermic frequency is low. Moreover, FIG. 5C shows a relation between the exothermic frequency and the attained density in a case where the maximum exothermic frequency is high, and FIG. 5D is a view showing a relation between density of print data and a state of division.

As shown in FIG. 5A, one dot in a sublimation printing is constituted as a set of exothermic units (cells) 501 in a case where the maximum exothermic frequency is low (four times in this example), and is constituted as a set of exothermic units 502 in a case where the maximum exothermic frequency is high (eight times in this example). Then, the tone is expressed by the exothermic frequency of the thermal head 310 (i.e., the number of times of making the ink sublimate and adsorb to the printing sheet) with respect to the maximum exothermic frequency defined with respect to one dot.

FIG. 5B corresponds to the exothermic unit 501 in FIG. 5A, and the maximum exothermic frequency is "4". FIG. 5C corresponds to the exothermic unit 502 in FIG. 5A, and the maximum exothermic frequency is "8". In both examples in FIG. 5B and FIG. 5C, the density increases as the exothermic frequency increases. Since the tone expression improves as the maximum exothermic frequency increases, the example shown in FIG. 5C is excellent in the tone expression.

On the other hand, the highest attained density D1 in FIG. 5B becomes higher than the highest attained density D2 in FIG. 5C. This is because the total heating time in the maximum exothermic frequency increases as the exothermic unit enlarges.

Next, division of print data will be described. Pre-division print data is two-dimensional multi valued data corresponding to a size of a printing sheet, and is generated as an array D[i, j] for each of colors including yellow (Y), magenta (M), and cyan (C). Here, the D[i, j] is described as multi valued data of 8 bits (from 0 to 255).

As shown in FIG. 5D, when the pre-division print data D[i, j] (density of a dot) is not less than a predetermined threshold TD, the pre-division print data is divided into two portions using a division coefficient L. And first printing data with the low maximum exothermic frequency (although the tone expression is poor, the highest attained density is high) and second printing data with the high maximum exothermic frequency (although the tone expression excels, the highest attained density is low) are generated. It should be noted that the division coefficient L takes a value ranging from 0 to 100. Change of the division coefficient L changes the division ratio of the D[i, j]. When the pre-division print data D[i, j] is less than the threshold TD, only the printing data with the high maximum exothermic frequency is generated. A no-division area in a low density area is determined on the basis of the threshold TD, and the pre-division print data D[i, j] is output as the post-division printing data DA[i, j].

Namely, when the density of the pre-division print data is not less than the threshold, a high density portion is printed using the exothermic unit 501 shown in FIG. 5A with the low maximum exothermic frequency in the first printing, and subsequently, the second printing is performed using the exothermic unit 502 shown in FIG. 5A with the high maximum exothermic frequency so as to complement the tone expression.

Figure 6:
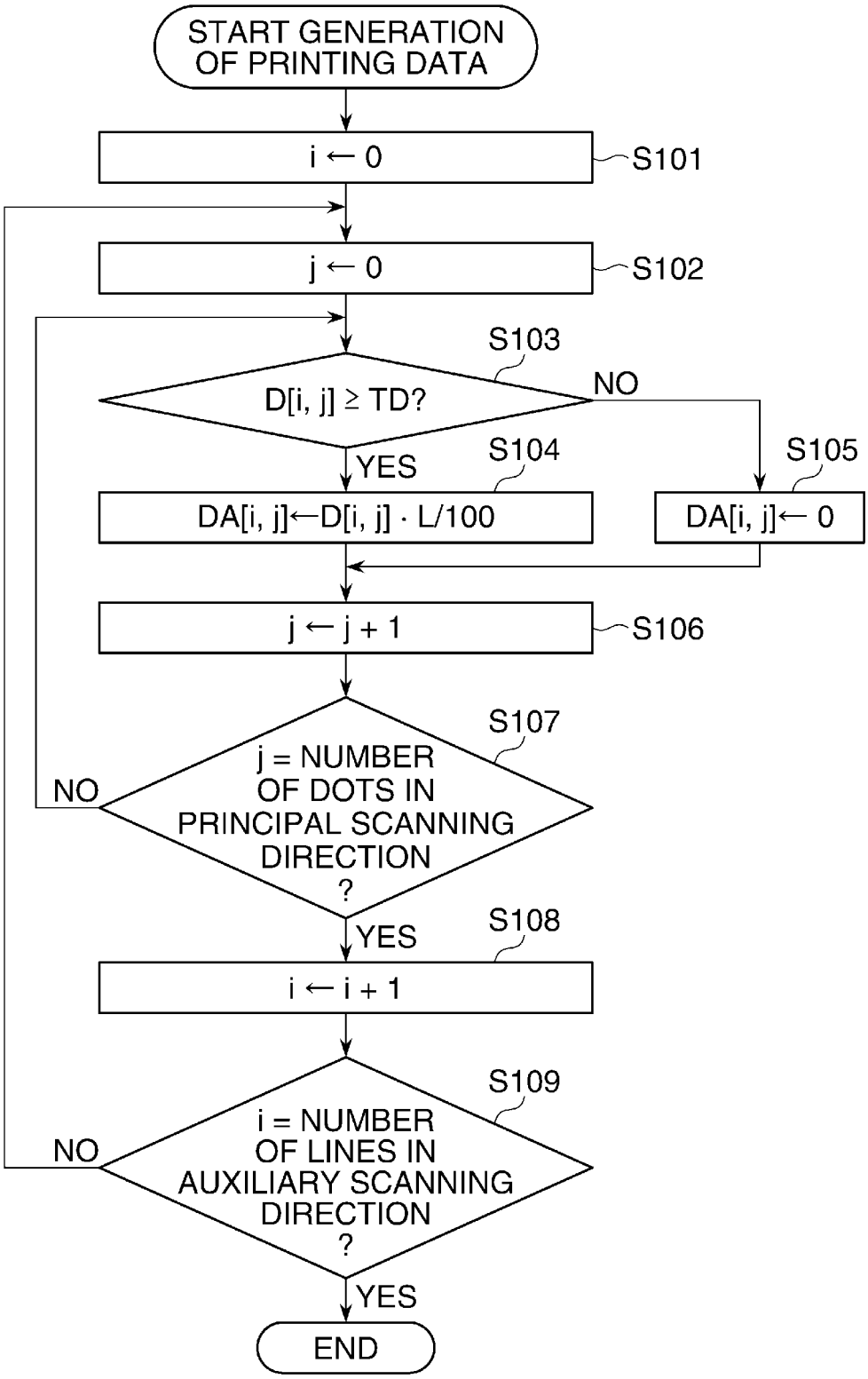
FIG. 6 is a flowchart showing a generation process for printing data with a low maximum exothermic frequency executed in the step S504 in FIG. 3A.

FIG. 6 is a flowchart showing a generation process for the first printing data with the low maximum exothermic frequency executed in the step S504 in FIG. 3A.

When generation of the printing data is started, the MPU 319 initializes a counter (variable) i that counts the number of dots in the auxiliary scanning direction of the thermal head 310 to "0" (step S101). Next, the MPU 319 initializes a counter (variable) j that counts the number of dots in the principal scanning direction of the thermal head 310 to "0" (step S102).

Subsequently, the MPU 319 determines whether the pre-division print data D[i, j], which is a two-dimensional array, is not less than the threshold TD (step S103). When the D[i, j] is not less than the threshold TD (YES in the step S103), the MPU 319 divides the pre-division print data D[i, j] into a portion of L % of the D[i, j] and a portion of (100−L)% of the D[i, j] as shown in a formula (1) using the division coefficient L. Then, the MPU 319 sets the post-division printing data DA[i, j] to L % of the D[i, j] as shown in a formula (2) (step S104).

$$D[i,j]=D[i,j]\cdot L/100+D[i,j]\cdot(100-L)/100 \quad (1)$$

$$DA[i,j]=D[i,j]\cdot L/100 \quad (2)$$

On the other hand, when the D[i, j] is less than the threshold TD (NO in the step S103), the MPU 319 sets the post-division-printing data DA[i, j] to zero as shown in a formula (3). In this case, the corresponding dot is not printed in the corresponding color in the first printing process.

$$DA[i,j]=0 \quad (3)$$

That is, when the density of the pre-division print data D[i, j] is less than the threshold TD, the corresponding dot can be printed by one printing process. Accordingly, the first printing process that is rough in the tone expression is not performed, and only a second printing process that is fine in the tone expression is performed as mentioned later.

After the process in the step S104 or S105, the MPU 319 increments the counter j (step S106). Then, the MPU 319 determines whether the division processes for all the dots in the principal scanning direction are completed (step S107).

When the division processes for not all the dots in the principal scanning direction are completed (NO in the step S107), the MPU 319 returns the process to the step S103, and performs the division processes for the following dots in the principal scanning direction. When the division processes for all the dots in the principal scanning direction are completed (YES in the step S107), the MPU 319 increments the counter i (step S108).

Subsequently, the MPU 319 determines whether the division processes for all the lines in the auxiliary scanning direction are completed (step S109). When the division processes for not all the lines in the auxiliary scanning direction are completed (NO in the step S109), the MPU 319 returns the process to the step S102, initializes the counter j in the principal scanning direction to "0", and performs the division processes for the following lines in the auxiliary scanning direction.

When the division processes for all the lines in the auxiliary scanning direction are completed (YES in the step S109), the MPU 319 finishes generation of the first printing data concerning the first printing.

Figure 7:
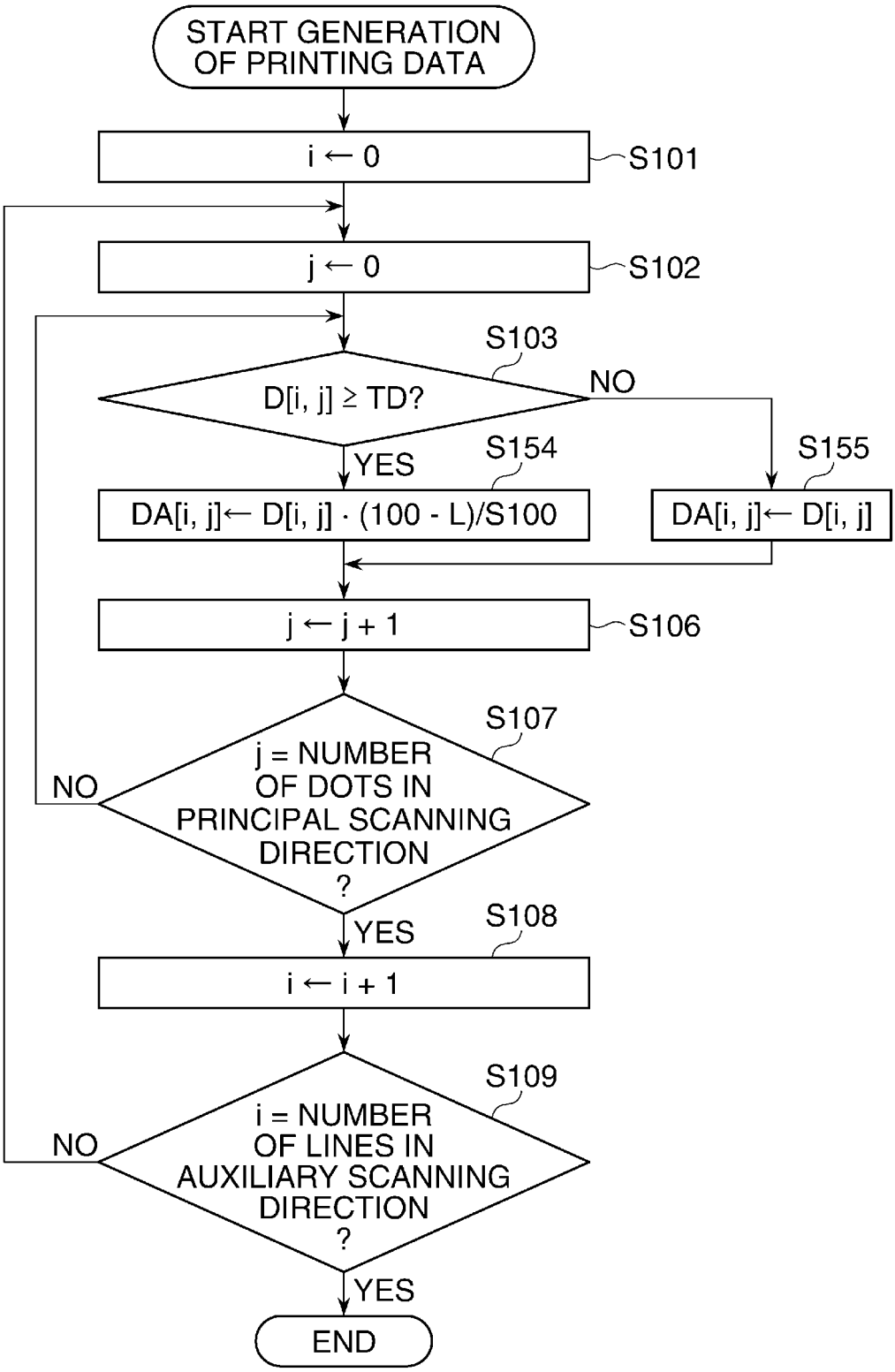
FIG. 7 is a flowchart showing a generation process for printing data with a high maximum exothermic frequency executed in the step S512 in FIG. 3B.

FIG. 7 is a flowchart showing a generation process for the second printing data with the high maximum exothermic frequency executed in the step S512 in FIG. 3B. It should be noted that steps in FIG. 7 that are the same as the steps in the flowchart in FIG. 6 are labeled by the same reference numerals, and their descriptions are omitted.

This process generates the second printing data with the high maximum exothermic frequency used in the second printing process as compared with the first printing data with the low maximum exothermic frequency used in the first printing process. When the second printing process is performed with the high maximum exothermic frequency so as to be superimposed on the image printed in the first printing process, the tone becomes higher.

When the D[i, j] is not less than the threshold TD in the process in the step S103, the MPU 319 sets the post-division printing data DA[i, j] to (100−L)% of the D[i, j] as shown in a formula (4) (step S154).

$$DA[i,j]=D[i,j]\cdot(100-L)/100 \quad (4)$$

On the other hand, when the D[i, j] is less than the threshold TD, the MPU 319 equalizes the post-division printing data DA[i, j] to the pre-division print data D[i, j] as shown in a formula (5) (step S155).

$$DA[i,j]=D[i,j] \quad (5)$$

After the process in the step S154 or S155, the MPU 319 proceeds with the process to the step S106, and generates the second printing data.

Here, the above-mentioned threshold TD and the division coefficient L will be described.

As mentioned above, the highest attained density D1 of the first printing process is higher than the highest attained density D2 of the second printing process. Accordingly, it is necessary that division ratio (division rate) of the printing data with the low maximum exothermic frequency be set up higher than the division ratio of the printing data with the high maximum exothermic frequency. Moreover, the printing process with the low maximum exothermic frequency, which is the first printing process, and the printing process with the high maximum exothermic frequency, which is the second printing process, are required to attain their highest attained density by heating by their maximum exothermic frequencies. For the purpose, it is necessary to satisfy a condition shown in the following formula (6).

$$L>50 \quad (6)$$

On the other hand, when the threshold TD will be selected, it should be considered that only the second printing process is performed when the pre-division print data is less than the threshold TD. Accordingly, the threshold TD needs to satisfy the relationship shown by a formula (7) with the maximum divided amount 255×(100−L)/100 in the case of D[i, j]=255.

$$TD\leq 255\cdot(100-L)/100 \quad (7)$$

Thus, the threshold TD is selected so as not to exceed the maximum divided amount in the printing data with the high maximum exothermic frequency.

It should be noted that the thermal control IC 309 successively converts the post-division printing data into the exothermic frequency of the thermal head 310 in the printing processes shown in the step S507 in FIG. 3A and the step S515 in FIG. 3B. The thermal control IC 309 is provided with a conversion table for the low maximum exothermic frequency and a conversion table for the high maximum exothermic frequency for each color. That is, the thermal control IC 309 is provided with six conversion tables, and converts the post-division printing data into the exothermic frequency of the thermal head 310.

Thus, the first embodiment of the present invention copes of both the highest attained density and the tone when a plurality of printing processes are performed so as to be superimposed. In addition, printed matter with the sufficient image quality is obtained without affecting the resolution. This enables to provide a user-friendly thermal sublimation printing apparatus.

Next, one example of a printing apparatus according to a second embodiment of the present invention will be described. It should be noted that the configuration of the printing apparatus of the second embodiment is the same as the printing apparatus shown in FIG. 1. Moreover, a printing process in the second embodiment is different from the printing process in the first embodiment described with reference to FIG. 3A and FIG. 3B, the other processes are the same as that in the first embodiment.

Figure 8:
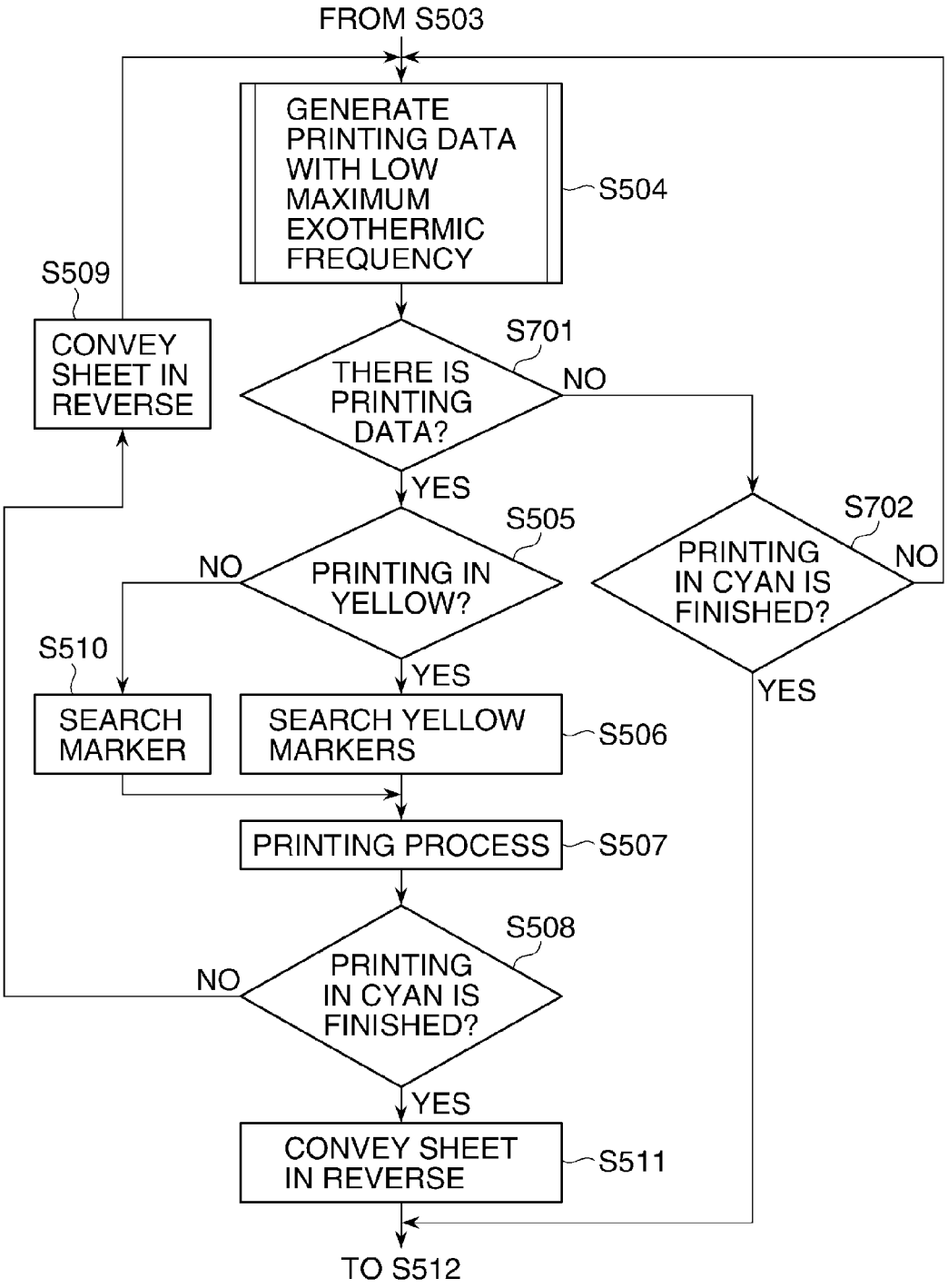
FIG. 8 is a flowchart showing a part of a printing process performed by a printing apparatus according to a second embodiment of the present invention.

FIG. 8 is a flowchart showing a part of the printing process performed by the printing apparatus according to the second embodiment of the present invention. It should be noted that steps in FIG. 8 that are the same as the steps in the flowchart in FIG. 3A are labeled by the same reference numerals, and their descriptions are omitted.

After generating the first printing data with the low maximum exothermic frequency in the step S504, the MPU 319 determines whether there is printing data (step S701). Here, when the post-division printing data DA[i, j] about all the dots is set to "0" (i.e., there is no printing data), the printing with the low maximum exothermic frequency becomes unnecessary about the color concerned. Accordingly, the MPU 319 determines the existence of printing data in the step S701.

When there is no printing data (NO in the step S701), the MPU 319 determines whether a process in cyan (C) is completed in the step S504 (step S702). When the process in cyan (C) is not completed (NO in the step S702), the MPU 319 returns the process to the step S504, and performs the printing-data generation process in the following color. In this case, the operations concerning the printing, such as the winding up of the ink ribbon, are not performed.

On the other hand, when the process in cyan (C) is completed (YES in the step S702), the MPU 319 proceeds with the process to the step S512, and generates the second printing data with the high maximum exothermic frequency.

When there is printing data (YES in the step S701), the MPU 319 proceeds with the process to the step S505, and determines whether the printing in yellow will be performed.

It should be noted that the printing sheet is positioned at the print starting position when it is determined that the printing in cyan (C) is finished in the step S702. Accordingly, the process in the step S512 is performed without performing the process in the step S511 described with reference to FIG. 3A and FIG. 3B.

In the second embodiment, when there is no first printing data for one of three colors including yellow (Y), magenta (M), and cyan (C), for example, the printing process corresponding to the color of which the first printing data does not exist is not performed. In particular, when there is no printing data in all the three colors including yellow (Y), magenta (M), and cyan (C), the ink ribbon is not used, which enables to save the ink ribbon.

Thus, the second embodiment of the present invention copes of both the highest attained density and the tone when a plurality of printing processes are performed so as to be superimposed. In addition, printed matter with the sufficient image quality is obtained without affecting the resolution. This enables to provide a user-friendly thermal sublimation printing apparatus.

Although the above-mentioned first and second embodiments describe the case where the printing repeats twice, they can be similarly applied to a case where the printing repeats three times or more. That is, the above-mentioned printing apparatus can be used in a case where the ink is transferred a plurality of times (a case where an image is printed according to print data by transferring the same color ink a plurality of times onto a printing sheet so as to be superimposed).

As is evident from the above-mentioned description, the MPU 319 controls the entire printing apparatus, and performs a calculation process, the generation process for printing data, etc. in the example shown in FIG. 1. It should be noted that the MPU 319, the RAM 308, the ROM 307, the thermal control IC 309, and the drivers may be implemented as the respective dedicated circuits, or may be implemented by programming a general-purpose processor. Moreover, a plurality of circuits and processors may achieve each block, or one circuit and one processor may achieve the functions of a plurality of blocks.

Although the embodiments of the present invention have been described, the present invention is not limited to the above-mentioned embodiments, the present invention includes various modifications as long as the concept of the invention is not deviated.

For example, the functions of the above mentioned embodiments may be achieved as a control method that is executed by a printing apparatus. Moreover, the functions of the above mentioned embodiments may be achieved as a control program that is executed by a computer with which the printing apparatus is provided. It should be noted that the control program is recorded into a computer-readable storage medium, for example.

Each of the above-mentioned control method and control program has a control step and a printing step at least.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-216329, filed Oct. 23, 2014, which is hereby incorporated by reference herein in its entirety.

What is claimed is:

1. A printing apparatus comprising:

a printing unit configured to print an image by transferring ink to a printing sheet with a thermal head according to print data of multiple values; and a control unit configured to control said printing unit so as to change a maximum exothermic frequency in one dot according to a transfer frequency at the time of transferring ink of a same color a plurality of times to overlap, when an image is printed based on the print data by transferring ink of the same color the plurality of times to overlap.

2. The printing apparatus according to claim 1, wherein said control unit generates printing data for driving said thermal head based on the print data, and wherein said control unit generates a plurality of pieces of printing data, when a same color of ink is transferred a plurality of times onto a printing sheet so as to be superimposed.

3. The printing apparatus according to claim 2, wherein said control unit generates a plurality of pieces of printing data of which maximum exothermic frequencies for one dot are different based on the print data.

4. The printing apparatus according to claim 3, wherein said control unit generates first printing data of which a maximum exothermic frequency is equal to a first exothermic frequency and second printing data of which a maximum exothermic frequency is equal to a second exothermic frequency that is higher than the first exothermic frequency based on the print data, when density of the print data is not less than a predetermined threshold.

5. The printing apparatus according to claim 4, wherein said control unit sets the first printing data to zero and sets the second printing data to the print data, when the density of the print data is less than the predetermined threshold.

6. The printing apparatus according to claim 5, wherein said control unit determines whether there is the first printing data, and prints with only the second printing data when there is no first printing data.

7. The printing apparatus according to claim 4, wherein said control unit generates the first printing data and the second printing data by dividing the print data according to a division coefficient that indicates a predetermined division ratio.

8. The printing apparatus according to claim 7, wherein the division coefficient is set up so that the division ratio of the first printing data becomes larger than the division ratio of the second printing data.

9. The printing apparatus according to claim 1, wherein the ink comprises inks in a plurality of colors.

10. A control method for a printing apparatus, the control method comprising:

a printing step of printing an image by transferring ink to a printing sheet with a thermal head according to print data of multiple values; and a control step of controlling printing so as to change a maximum exothermic frequency in one dot according to a transfer frequency at the time of transferring ink of a same color a plurality of times to overlap, when an image is printed based on the print data by transferring ink of the same color the plurality of times to overlap.

11. A non-transitory computer-readable storage medium storing a control program causing a computer to execute a control method for a printing apparatus, the control method comprising:

a printing step of printing an image by transferring ink to a printing sheet with a thermal head according to print data of multiple values; and a control step of controlling printing so as to change a maximum exothermic frequency in one dot according to a transfer frequency at the time of transferring ink of a same color a plurality of times to overlap, when an image is printed based on the print data by transferring ink of the same color the plurality of times to overlap.

* * * * *